US005351369A

United States Patent [19]

Swain

[11] Patent Number: 5,351,369

[45] Date of Patent: Oct. 4, 1994

[54] MOISTURE-RESISTANT FASTENER

[75] Inventor: Henry L. Swain, Bridgewater, N.J.

[73] Assignee: Illinois Tool Works, Inc., Glenview, Ill.

[21] Appl. No.: 899,458

[22] Filed: Jun. 16, 1992

[51] Int. Cl.[5] ..... B65D 33/16

[52] U.S. Cl. ..... 24/304; 24/576; 24/587

[58] Field of Search ..... 24/576, 587, 304; 383/63, 65

[56] References Cited

U.S. PATENT DOCUMENTS

| | | | |
|---|---|---|---|
| 2,407,553 | 9/1946 | Hoesel . | |
| 2,484,645 | 10/1949 | Baumle . | |
| 2,741,288 | 4/1956 | Johnson . | |
| 2,780,261 | 2/1957 | Svec et al. | 383/65 |
| 3,176,364 | 4/1965 | Dritz | 24/306 X |
| 3,440,696 | 4/1969 | Staller | 24/576 |
| 3,597,781 | 8/1971 | Eibes . | |
| 3,959,856 | 6/1976 | Ausnit . | |
| 4,372,014 | 2/1983 | Simpson . | |
| 4,731,911 | 3/1988 | Gould | 24/576 X |
| 4,762,450 | 8/1988 | Schwind . | |
| 4,841,603 | 6/1989 | Ragni | 24/576 |
| 4,878,763 | 11/1989 | Ausnit | 24/576 X |
| 4,947,525 | 8/1990 | Van Erden . | |
| 5,065,490 | 11/1991 | Wivagg . | |

FOREIGN PATENT DOCUMENTS 1145325 3/1969 United Kingdom .

*Primary Examiner*—James R. Brittain

*Attorney, Agent, or Firm*—Kane, Dalsimer, Sullivan, Kurucz, Levy, Eisele and Richard

[57] ABSTRACT

A moisture-resistant fastener, which may be incorporated as part of a bag, pouch, wrapper, or liner, or which may be used as a protective garment closure, includes a pair of flexible closure strips. The strips include interlocking ribs and channels of complementary cross-sectional shape which lock together in an interference fit. The ribs have enlarged heads, and, complementarily, the channels have enlarged bottoms. At least one of the enlarged heads and enlarged bottoms has an integrally formed longitudinal gasket of a polymeric material softer than that used to extrude the flexible closure strips. When the flexible closure strips are locked together by forcing the ribs of one into the channels of the other to establish the interference fit, the longitudinal gasket is compressed and forms a moisture-resistant seal having an effectiveness heretofore not available or achievable.

23 Claims, 4 Drawing Sheets

FIG. 7
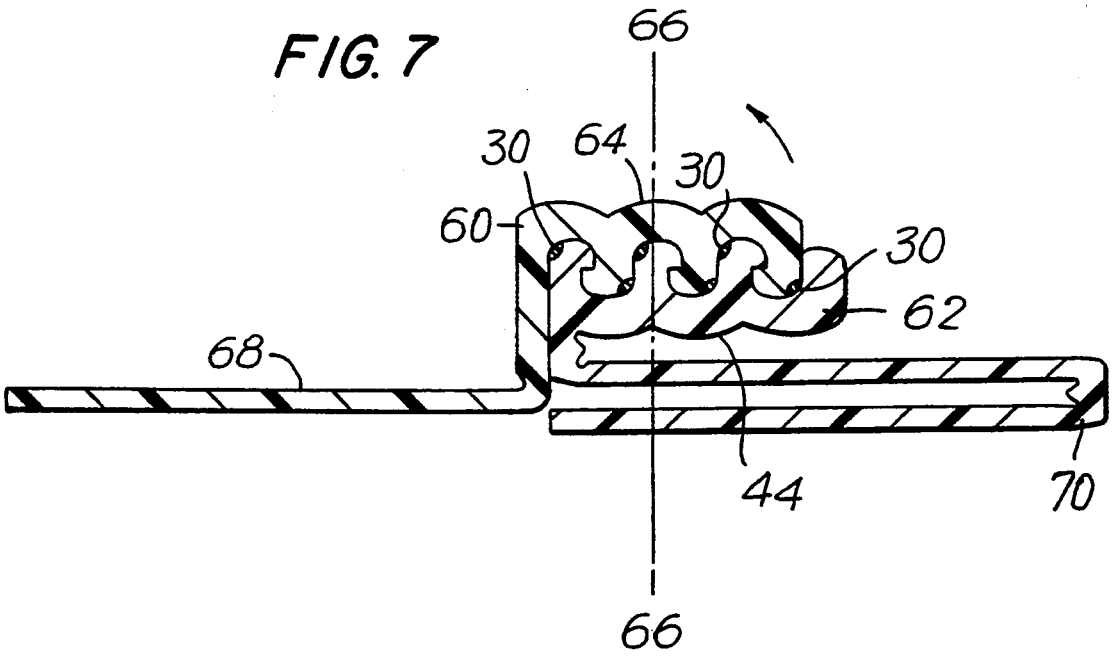
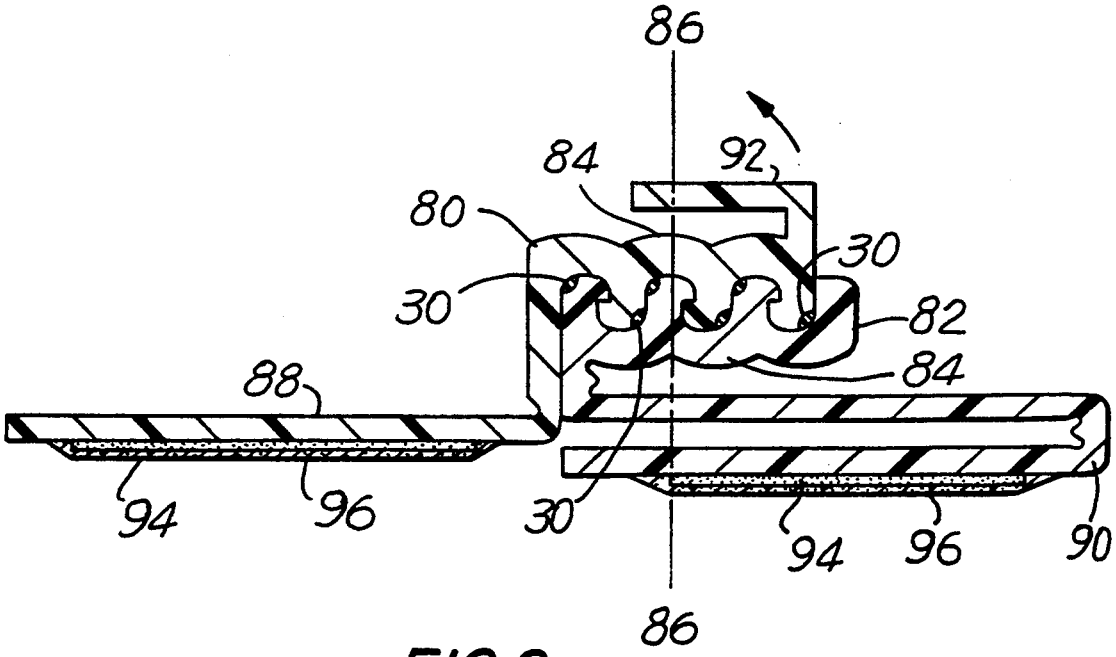
FIG. 8

MOISTURE-RESISTANT FASTENER

BACKGROUND OF THE INVENTION

1. Field of the Invention

The present invention relates to improvements in resilient fasteners that provide flexible closures for a variety of different uses such as on bags, pouches, wrappers, liners and protective garments. The present invention, more specifically, relates to a new and improved resilient fastener which is more moisture-resistant than those of the prior art.

2. Description of the Prior Art

Resilient fasteners are well known in the art. Generally, fasteners of this variety include a pair of flexible closure strips, each extruded from a polymeric resin material in continuous lengths and having an interlocking rib and groove structure. A leak-proof fastener of this type has long been sought in the industry, but has heretofore not been achieved. The problem, generally stated, is that sufficient clearance must be provided to enable the interlocking ribs and grooves to fit together when the fastener is being closed. The need for this clearance has made the provision of a completely leak-proof slide fastener difficult, as fluid or vapor has been ultimately able to pass through the closed fastener by way of the clearance spaces between its interlocked ribs and grooves.

The present invention provides a fastener which is more moisture-resistant than has heretofore been available.

SUMMARY OF THE INVENTION

The present invention is provided in two broad forms or aspects. The first is a moisture-resistant fastener designed for incorporation as part of a bag, pouch, wrapper or liner.

The moisture-resistant fastener comprises a pair of flexible closure strips, each of which has a web portion and a marginal strip portion. The web portion, which is substantially flat or planar, is provided to enable the flexible closure strip to be attached to the elements to be joined by the moisture-resistant fastener. This element may be, for example, one of two sides of a plastic bag, or a plastic sheet, which is to be joined with others, by means of the moisture-resistant fastener of the present invention, to provide a plastic liner of considerable area.

The marginal strip portions of the flexible closure strips are provided with means by which they may be interlocked with one another. One of the marginal strip portions has at least one solid form-retaining longitudinal rib having an undercut interlocking hook along one side to form an enlarged head.

The other marginal strip portion has at least one longitudinal channel having an undercut interlocking groove along one side to form an enlarged bottom. The channel is generally complementary in cross-sectional shape to the rib in the other marginal strip portion, so that the rib may interlock therewithin in an interference fit when the interlocking hook is engaged within the interlocking groove.

In order to provide the present moisture-resistant fastener with an improved degree of moisture resistance, at least one of the enlarged head on the longitudinal rib on the marginal strip portion and the enlarged bottom of the longitudinal channel in the other marginal strip portion is provided with an integrally formed longitudinal gasket. The gasket, for example, may extend along the enlarged head of the rib, along the enlarged bottom of the channel, or along both.

Each flexible closure strip is extruded from a polymeric material. The integrally formed longitudinal gasket is formed by co-extrusion using another polymeric material softer than that used for the flexible closure strip as a whole. Whether the gasket is in the bottom of the channel or on the head of the rib, when viewed in cross section it has the appearance of a bead. This bead is of a softer material than the rib or channel material. As a consequence, when rib is forced into channel to establish an interference fit and to close the moisture-resistant fastener, the integrally formed gasket is compressed therebetween to close off any clearance space and to render the closed fastener more moisture-resistant than has been heretofore possible.

The other broad aspect of the present invention is a protective garment closure for a plastic coverall of the variety worn by workers in areas contaminated by asbestos or radioactivity, emergency medical personnel, ambulance drivers, and the like. The closure portions, that is, the marginal strip portions, of the protective garment closure, are identical to those described above, and, as a consequence, have a level of moisture-resistance not available in the protective garment closures of the prior art.

In the protective garment closure of the present invention, the web portions of the flexible closure strips have been adapted for use in this specific purpose. One of the two web portions is flat, or planar, and has, on one of its two surfaces, a layer of adhesive, so that it may be applied and adhered to an edge of an opening in a protective garment. The adhesive may, in turn, have a coating of wax, particularly where the adhesive is of the sort that may be activated by heat. Alternatively, the adhesive may be pressure-sensitive, and may be covered by a strip of paper or plastic to be removed immediately before the application of the web portion along the edge of an opening in a protective garment.

The other web portion has a longitudinally folded portion, so that, in effect, the web portion is double-layered. The backside of the folded portion facing away from the marginal strip portions, is also coated with a layer of adhesive in the manner described above, so that the web portion may be applied and adhered to the other edge of the opening in a protective garment. The folded web portion allows the closed protective garment to give or expand somewhat in response to the movements of its wearer without placing an undue strain on the interlocked marginal strip portions themselves.

When used as a protective garment closure, the web portions of the flexible closure strips are attached to the interlocked marginal portions at the same side of a centerline therethrough. This permits the marginal strip portions of the protective garment closure to be pivoted outward by 90° from the body of the wearer, who may then seal them together by running a thumb and forefinger, squeezing the marginal strip portions together, up the closure. Once closed, the protective garment closure turns back parallel to the body of the wearer of its own accord. One of the two marginal strip portions may be provided with a longitudinal pull-tab to facilitate the opening of the garment closure following use.

The present invention will now be described in more complete detail with frequent reference being made to the drawing figures identified below.

BRIEF DESCRIPTION OF THE DRAWINGS

FIG. 7 is a cross section of still another embodiment of the moisture-resistant fastener of the present invention.

FIG. 8 is a cross section of yet another embodiment of the moisture-resistant fastener, one particularly adapted for use as a protective garment closure.

DETAILED DESCRIPTION OF THE PREFERRED EMBODIMENT

Figure 1:
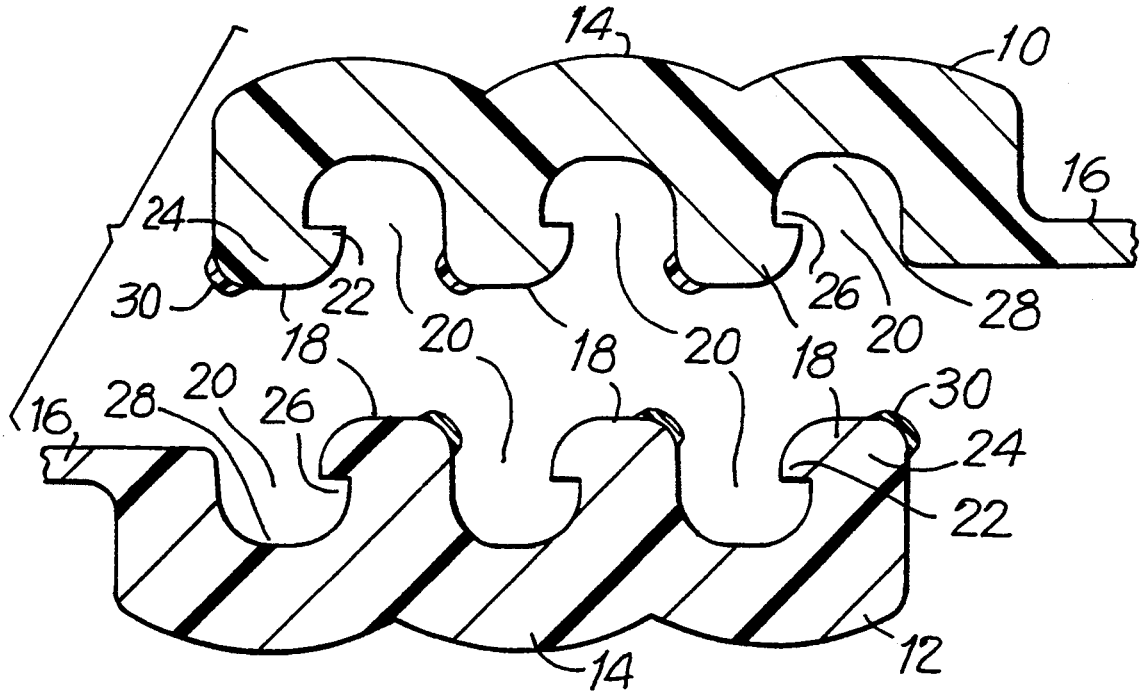
FIG. 1 is a cross section of two flexible closure strips prior to their being interlocked with one another.

In FIG. 1, a pair of flexible closure strips of the moisture-resistant fastener of the present invention is shown. The first flexible closure strip 10 and the second flexible closure strip 12 are, as shown in FIG. 1, identical to one another, so that elements of one, described and labelled in the paragraphs to follow, may be described in identical terms, and are identically labelled in the figures.

The flexible closure strips 10,12 each have a marginal strip portion 14 and a web portion 16, the latter of which is not completely shown. The marginal strip portions 14 have solid form-retaining longitudinal ribs 18 and longitudinal channels 20. The ribs 18 have an undercut interlocking hook 22 on one side thereof which forms an enlarged head 24. In like manner, the channels 20 have an undercut interlocking groove 26 and an enlarged bottom 28. The channels 20 are generally complementary to the ribs 18, so that they may lock together, as shown in FIG. 2, in an interference fit by the engagement of hooks 18 with grooves 26.

Figure 2:
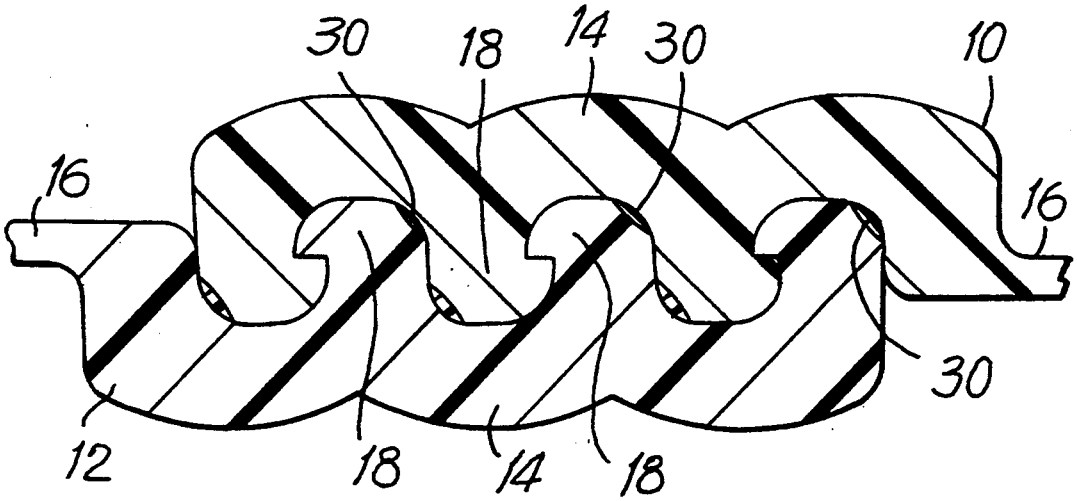
FIG. 2 is a cross section of two flexible closure strips shown in FIG. 1 interlocked with one another as in a closed fastener.

At a point along the head 24 of each longitudinal rib 18 is an integrally formed longitudinal gasket 30 which forms a moisture-resistant seal when the flexible closure strips 10,12 are interlocked as shown in FIG. 2. The flexible closure strips 10,12 are extruded from a first polymeric material, while the gasket 30 is co-extruded from a second polymeric material, compatible with the first, at the same time. As a consequence, gasket 30 is integrally connected to the flexible closure strips 10,12. The second polymeric material is of a variety having a lower hardness than the first polymeric material. As may be noted by comparing FIGS. 1 and 2, gaskets 30, having the appearance of beads in FIG. 1, are substantially compressed when the flexible closure strips 10,12 are interlocked with one another. This compression provides the desired moisture-resistant seal between ribs 18 and channels 20 when the two are interlocked together.

Figure 3:
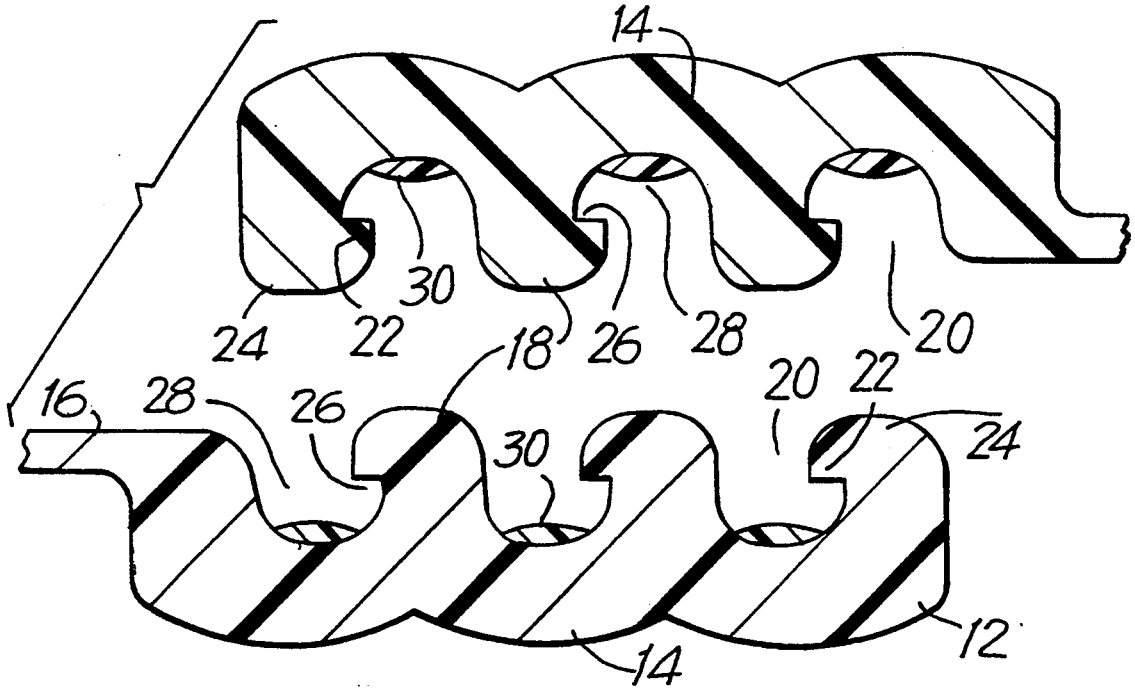
FIG. 3 is a cross section of two flexible closure strips of an alternate embodiment of the present invention prior to their being interlocked with one another.
Figure 4:
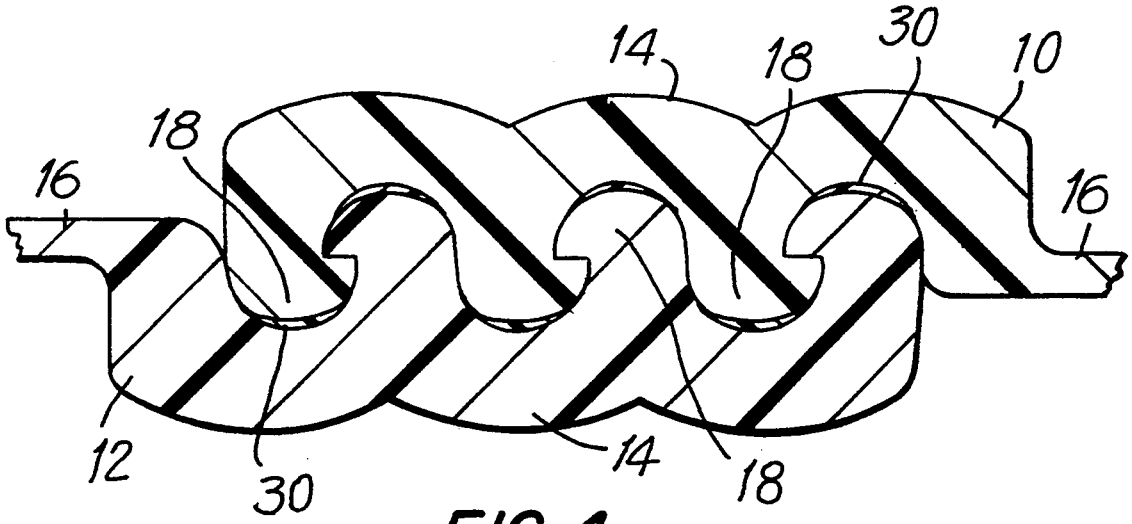
FIG. 4 is a cross section of the two flexible closure strips shown in FIG. 3 interlocked with one another as in a closed fastener.

With reference now to FIGS. 3 and 4, which show an alternate embodiment of the present invention, much of the preceding discussion is equally applicable thereto and will not be repeated. Reference numerals, used in FIGS. 1 and 2, are used in FIGS. 3 and 4 to refer to corresponding elements of the moisture-resistant fastener shown therein. The difference in this alternate embodiment is that an integrally formed longitudinal gasket 30 is provided at a point along the bottom 28 of each longitudinal channel 20. Nevertheless, gaskets 30 are substantially compressed when the flexible closure strips 10,12 in FIG. 3 are interlocked with one another, as shown in FIG. 4. This compression again provides the desired moisture-resistant seal between ribs 18 and channels 20 when the two are interlocked together.

The first polymeric material may be a low to medium density polyethylene, or polypropylene or polyurethane. In general, it may be a polymeric material having a hardness in the range from 60 to 95 durometer.

The second polymeric material may be thermoplastic rubber (TPR) or styrene ethylene butydene styrene block copolymer (SEBS). In general, it may be a polymeric material having a hardness in the range from 20 to 55 durometer, so long as it is compatible for the purposes of coextrusion with the material used as the first polymeric material.

Figure 5:
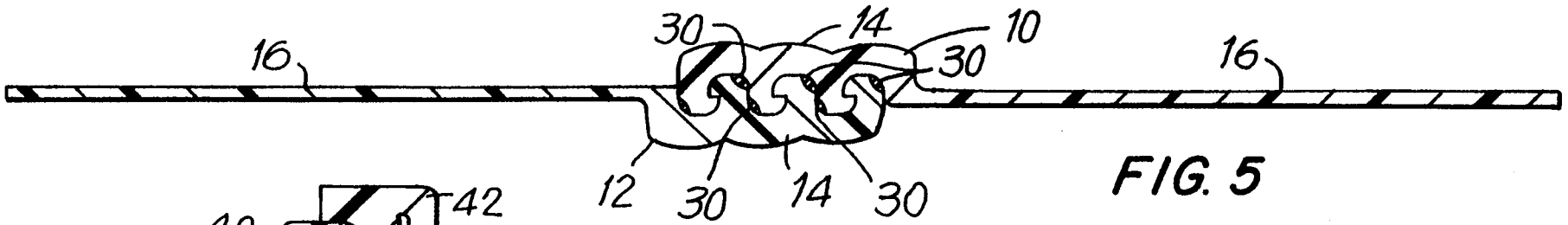
FIG. 5 is a cross section of an embodiment of the moisture-resistant fastener of the present invention.

FIG. 5 shows an embodiment of the present invention in cross section wherein the first flexible closure strip 10 and the second flexible closure strip 12 are substantially identical to one another so that, when their respective marginal strip portions 14 are interlocked with one another in an interference fit, their respective web portions 16 lie on opposite sides of the interlocked marginal strip portions 14 in a substantially common plane. This embodiment of the present moisture-resistant fastener may be used in joining sheets of plastic material to form a liner of considerable area.

Figure 6:
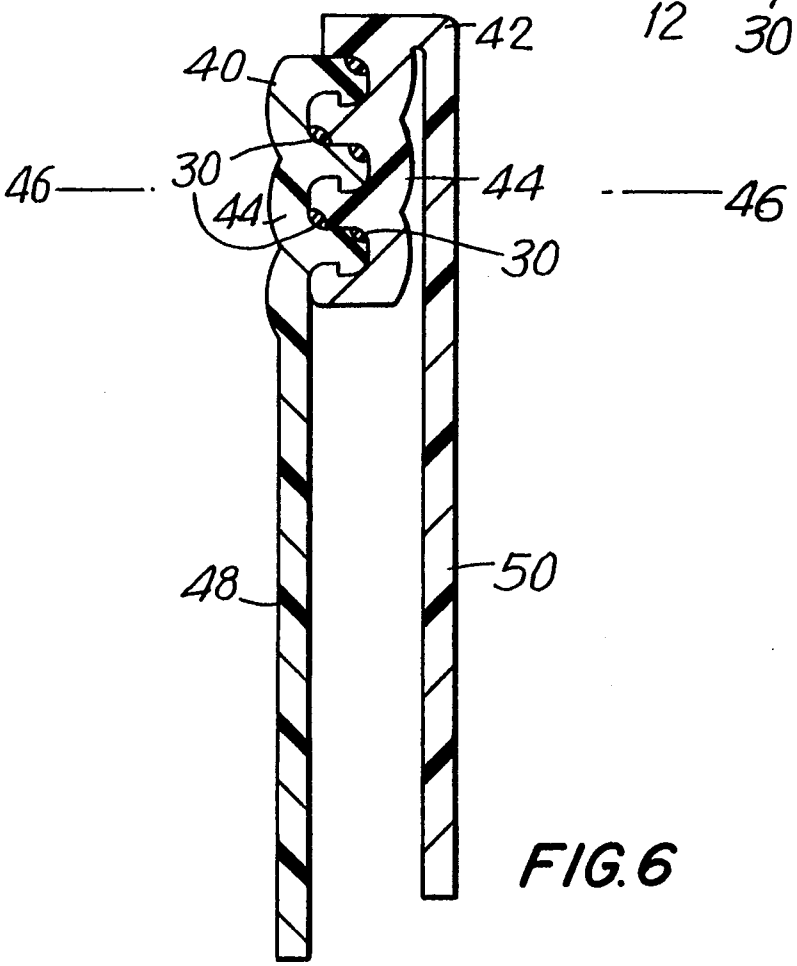
FIG. 6 is a cross section of another embodiment of the moisture resistant fastener of the present invention.

FIG. 6 shows an embodiment of the present invention useful for inclusion in a sealable plastic bag or pouch. In this instance, the first flexible closure strip 40 and the second flexible closure strip 42 are not identical to one another.

Continuing to use the same terminology as above, marginal strip portions 44 in FIG. 6 are shown in an interlocked condition and include longitudinal gaskets 30. Referring to a centerline 46, which may be drawn through interlocked marginal strip portions 44, the web portion 48 of first flexible closure strip 40 is on one side of the centerline 46, while web portion 50 of second flexible closure strip 42 is on the other side of the centerline. Both web portion 48 and web portion 50, however, extend in a substantially common direction to their respective marginal strip portions 44.

FIG. 7 shows still another embodiment of the present invention. This, and the embodiment to be shown in FIG. 8, are useful as protective garment closures. Again, the first flexible closure strip 60 and the second flexible closure strip 62 are not identical to each other.

Marginal strip portions 64 in FIG. 7 are shown in interlocked condition and include longitudinal gaskets 30. Referring to a centerline 66, which may be drawn through interlocked marginal strip portions 64, the web portion 68 is on one side of the centerline 66, and web portion 70 of second flexible closure strip 62 is on the same side of the centerline 66. This permits the marginal strip portions 64 to be pivoted outward in the direction indicated by the curved arrow from the web portions 68,70.

Both web portion 68 and web portion 70 extend in opposite directions from their points of attachment to their respective marginal strip portions 44 in a substantially common plane. However, web portion 70 has a longitudinal fold, so that, in effect, it is double-layered.

FIG. 8 shows a refinement of the embodiment shown in FIG. 7. This embodiment may be more useful than that shown in FIG. 7 as a protective garment closure.

Again, the first flexible closure strip 80 and the second flexible closure strip 82 are not identical to each other. Marginal strip portions 84 in FIG. 8 are shown in interlocked condition and include longitudinal gaskets 30. Referring to centerline 86, which may be drawn through interlocked marginal strip portions 84, the web portion 88 of the first flexible closure strip 80 is on one side of the centerline 86, and the web portion 90 of the second flexible closure strip 82 is on the same side of the centerline 86. This permits the marginal strip portions 84 to be pivoted outward in the direction indicated by the curved arrow from the web portions 88,90 to facilitate their being interlocked by hand when the protective garment closure shown in FIG. 8 is included in a protective garment.

Both web portion 88 and web portion 90 extend in opposite directions from their points of attachment to their respective marginal strip portions 84 in a substantially common plane. However, web portion 90 has a longitudinal fold, so that, in effect, it is double-layered. It should be noted in this regard that second flexible closure strip 62 in FIG. 7 and second flexible closure strip 82 in FIG. 8 are extruded through dies shaped to provide providing web portions 70,90 with the longitudinal fold.

First flexible closure strip 80 may also be provided with a longitudinal pull-tab 92 to enable the wearer of a protective garment with which the present invention is used to open the closure.

Referring to the sides of web portions 88,90 facing away from marginal strip portions 84, and adhesive layer 94 may be applied on each to enable the first flexible closure strip 80 and the second flexible closure strip 82 to be attached to opposite sides of an opening in a protective garment. A layer of wax 96 may be used to cover the adhesive 94, particularly where the adhesive 94 is heat-activated. The adhesive 94 may alternatively be pressure-sensitive.

Modifications to the above would be obvious to those skilled in the art without bringing the invention so modified beyond the scope of the appended claims.

What is claimed is:

1. A moisture-resistant fastener, comprising:

a first flexible closure strip and a second flexible closure strip, each flexible closure strip having a web portion and a marginal strip portion, said marginal strip portions of said first and second closure strips being formed of a first polymeric material;

said marginal strip portion of said first flexible closure strip having at least one solid form-retaining longitudinal rib having an undercut interlocking hook along one side thereof to form an enlarged head;

said marginal strip portion of said second flexible closure strip having at least one longitudinal channel having an undercut interlocking groove along one side thereof to form an enlarged bottom, said channel being generally complementary to said rib of said first flexible closure strip so that said rib may interlock therewithin with an interference fit when said hook is engaged within said groove;

at least one of said head on said longitudinal rib of said first flexible closure strip and said bottom of said longitudinal channel of said second flexible closure strip having an integrally formed longitudinal gasket of a second polymeric material softer than said first polymeric material, so that a moisture-resistant seal may be formed therebetween when said longitudinal rib of said first flexible closure strip is forced into said longitudinal channel of said second flexible closure strip to establish said interference fit, wherein said web portion of said first flexible closure strip is attached to its respective marginal strip portion at a point on one side of a centerline of said interlocked marginal strip portions, and wherein said web portion of said second flexible closure strip is attached to its respective marginal strip at a point on the same side of the centerline of said interlocked marginal strip portions, said web portions of said first and second flexible closure strips extending in opposite directions from said interlocked marginal strip portions and lying in a substantially common plane.

2. A moisture-resistant fastener as claimed in claim 1 wherein said web portion of said second flexible closure strip is longitudinally folded upon itself in a direction away from its respective marginal strip portion, so that said web portion may be double-layered and expandable in the manner of a Z-fold.

3. A moisture-resistant fastener as claimed in claim 1, further comprising a longitudinal pull-tab, said longitudinal pull-tab being attached to said marginal strip portion of said first flexible closure strip.

4. A moisture-resistant fastener as claimed in claim 1 wherein said first polymeric material is a low to medium density polyethylene.

5. A moisture-resistant fastener as claimed in claim 1 wherein said first polymeric material is polypropylene.

6. A moisture-resistant fastener as claimed in claim 1 wherein said first polymeric material is polyurethane.

7. A moisture-resistant fastener as claimed in claim 1 wherein said first polymeric material has a hardness in the range from 60 to 95 durometer.

8. A moisture-resistant fastener as claimed in claim 1 wherein said second polymeric material is thermoplastic rubber.

9. A moisture-resistant fastener as claimed in claim 1 wherein said second polymeric material is styrene ethylene butydene styrene block co-polymer.

10. A moisture-resistant fastener as claimed in claim 1 wherein said second polymeric material has a hardness in the range from 20 to 55 durometer.

11. A moisture-resistant fastener as claimed in claim 1 wherein said first polymeric material and said second polymeric material are compatible with one another for coextrusion.

12. A protective garment closure, comprising:

a first flexible closure strip and a second flexible closure strip, each flexible closure strip having a web portion and a marginal strip portion, said marginal strip portions of said first and second closure strips being formed of a first polymeric material;

said marginal strip portion of said first flexible closure strip having at least one solid form-retaining longitudinal rib having an undercut interlocking hook along one side thereof to form an enlarged head;

said marginal strip portion of said second flexible closure strip having at least one longitudinal channel having an undercut interlocking groove along one side thereof to form an enlarged bottom, said channel being generally complementary to said rib of said first flexible closure strip so that said rib may interlock therewithin with an interference fit when said hook is engaged within said groove;

at least one of said head on said longitudinal rib of said first flexible closure strip and said bottom of said longitudinal channel of said second flexible strip having an integrally formed longitudinal gasket of a second polymeric material softer than said first polymeric material, so that a moisture-resistant seal may be formed therebetween when said longitudinal rib of said first flexible closure strip is forced into said longitudinal channel of said second flexible closure strip to establish said interference fit;

said web portion of said first flexible closure strip being attached to its respective marginal strip portion at a point on one side of a centerline of said interlocked marginal strip portions, and said web portion of said second flexible closure strip is attached to its respective marginal strip portion at a point on the same side of the centerline of said interlocked marginal strip portions, said web portions of said first and second flexible closure strips extending in opposite directions from said interlocked marginal strip portions and lying in a substantially common plane, said web portion of said second flexible closure strip being longitudinally folded upon itself in a direction away from its respective marginal strip portion, so that said web portion of said second flexible closure strip may be double-layered and expandable in the manner of a Z-fold;

said web portion of said first flexible closure strip having a side facing away from said interlocked marginal strip portions and said folded web portion of said second flexible closure strip having a side facing away from said interlocked marginal strip portions, said sides having a coating of an adhesive, so that said protective garment closure may be attached to a protective garment with said web portion of said first flexible closure strip being attached to one side of an opening in the protective garment and said folded web portion of said second flexible closure strip being attached to the other side of the opening in the protective garment.

13. A protective garment closure as claimed in claim 12 further comprising a longitudinal pull-tab, said longitudinal pull tab being attached to said marginal strip portion of said first flexible closure strip.

14. A protective garment closure as claimed in claim 12 wherein said adhesive is of a heat-activated type and further comprising a coating of wax over said adhesive.

15. A protective garment closure as claimed in claim 12 wherein said adhesive is pressure-sensitive.

16. A protective garment closure as claimed in claim 12 wherein said first polymeric material is a low to medium density polyethylene.

17. A protective garment closure as claimed in claim 12 wherein said first polymeric material is polypropylene.

18. A protective garment closure as claimed in claim 12 wherein said first polymeric material is polyurethane.

19. A protective garment closure as claimed in claim 12 wherein said first polymeric material has a hardness in the range from 60 to 95 durometer.

20. A protective garment closure as claimed in claim 12 wherein said second polymeric material is thermoplastic rubber (TPR).

21. A protective garment closure as claimed in claim 12 wherein said second polymeric material is styrene ethylene butydene styrene block co-polymer.

22. A protective garment closure as claimed in claim 12 wherein said second polymeric material has a hardness in the range from 20 to 55 durometer.

23. A protective garment closure as claimed in claim 12 wherein said first polymeric material and said second polymeric material are compatible with one another for coextrusion.

* * * * *